United States Patent [19]

Howes, Jr.

[11] 3,982,758

[45] Sept. 28, 1976

[54] DUAL-USE TENNIS COURT PARKING LOT CONSTRUCTION METHODS AND APPARATUS

[76] Inventor: Charles L. Howes, Jr., 19 Covenant Lane, Georgetown, Conn. 06829

[22] Filed: Nov. 6, 1974

[21] Appl. No.: 521,516

[52] U.S. Cl. ..... 273/29 R; 273/29 BB; 272/3; 273/95 H

[51] Int. Cl.[2] ..... A63B 61/00

[58] Field of Search ..... 273/29 R, 95 H, 30, 273/128 R, 1 B, 1.5 R, 29 A, 29 BB; 272/3; 256/19, 24, 52

[56] References Cited

UNITED STATES PATENTS

| | | | |
|---|---|---|---|
| 337,591 | 3/1966 | Lee | 273/29 R X |
| 1,116,554 | 11/1914 | Boggis | 273/29 R |
| 1,484,514 | 2/1924 | Lloyd | 273/29 R |
| 1,556,046 | 10/1925 | Taylor | 273/1 R |
| 1,712,159 | 5/1929 | O'Donnell | 273/85 R |
| 2,237,669 | 4/1941 | Higman | 256/19 |
| 3,111,303 | 11/1963 | Olson | 256/19 |

FOREIGN PATENTS OR APPLICATIONS

| | | | |
|---|---|---|---|
| 183,996 | 8/1922 | United Kingdom | 272/3 |
| 397,115 | 8/1933 | United Kingdom | 273/29 BB |
| 599,727 | 3/1948 | United Kingdom | 273/95 H |
| 4,400 | 9/1883 | United Kingdom | 273/29 BB |

OTHER PUBLICATIONS

The Evening Star, Washington, D.C. Aug. 6, 1968.

*Primary Examiner*—Richard C. Pinkham
*Assistant Examiner*—T. Brown

[57] ABSTRACT

Apparatus for constructing a temporary, removable tennis court on a paved vehicle parking lot are described. Provisions are made for two contrasting types of pavement markings, and for two sets of socket holes in the pavement which receive complementary posts for nets and fencing, allowing quick and easy change from parking lot use to tennis court use and back again.

11 Claims, 6 Drawing Figures

FIG. 1
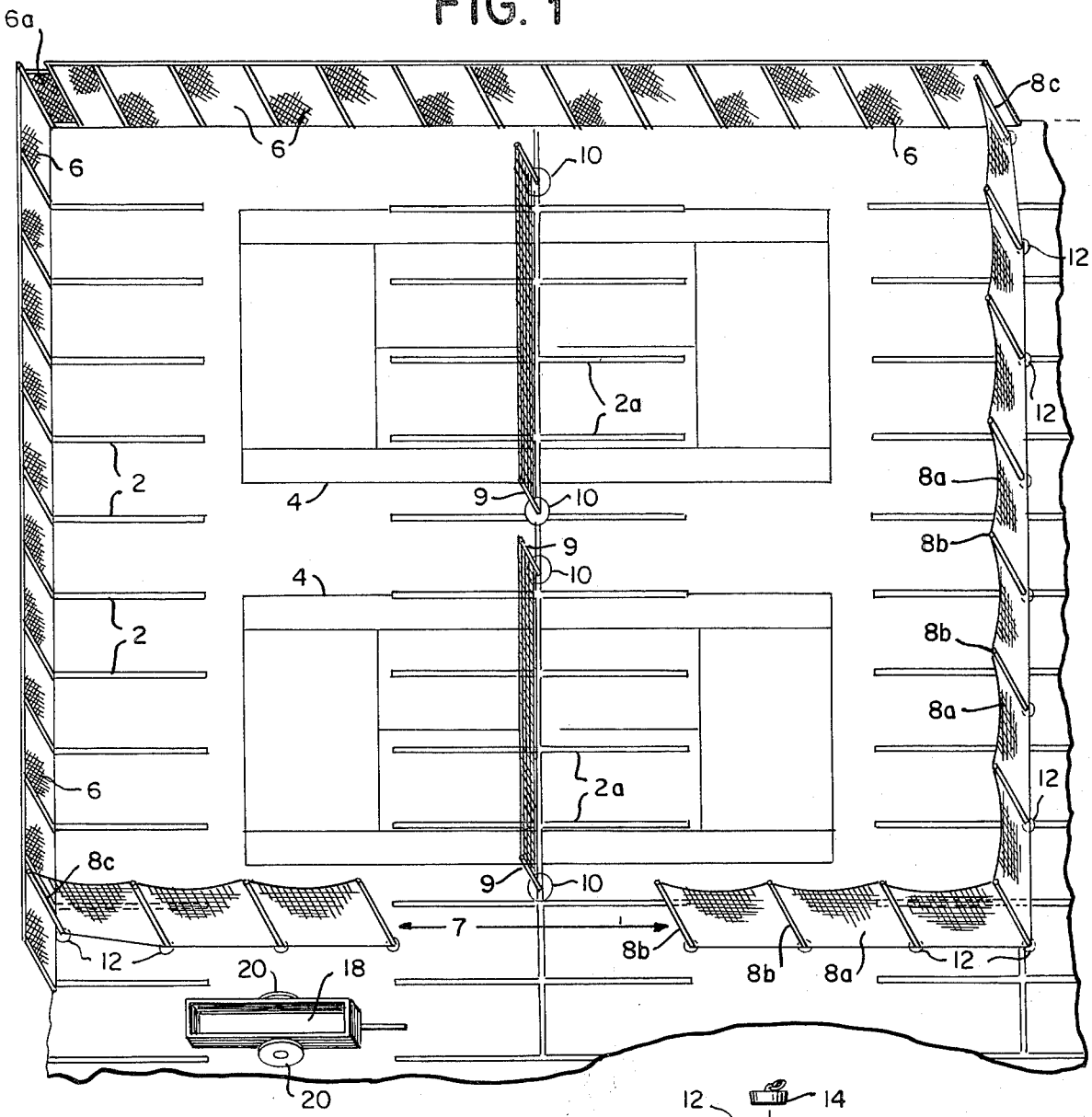
FIG. 2
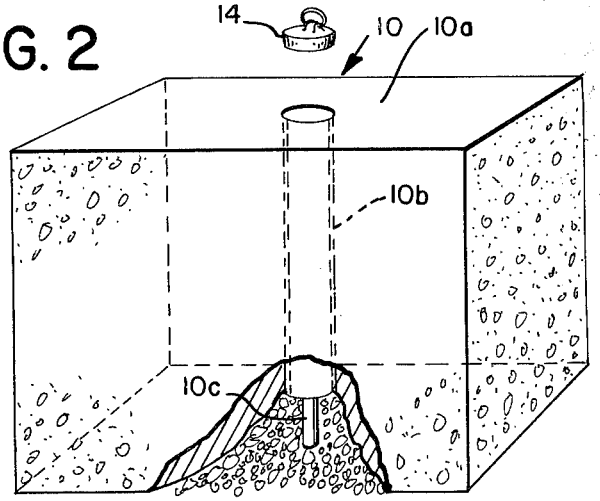
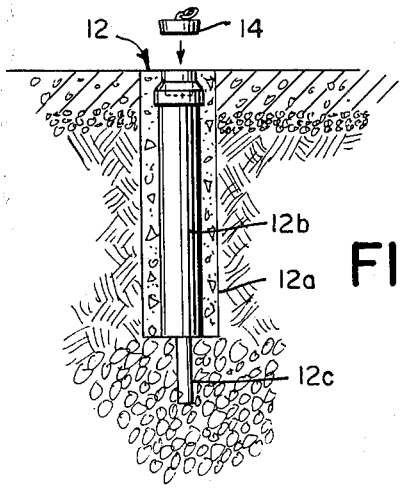
FIG. 3

DUAL-USE TENNIS COURT PARKING LOT CONSTRUCTION METHODS AND APPARATUS

BACKGROUND OF THE INVENTION

This invention relates to a novel tennis court construction and to its method of installation. A great amount of land has been devoted to the parking of automobiles and other vehicles at or near both public and private buildings. These parking areas, at such locations at stores, shopping centers, schools, banks, churches, libraries, governmental institutions, etc., require large areas of land, but are necessary for the convenience of people carrying on everyday business and pleasure activities. During a great deal of the time, however, these large parking areas are left vacant and essentially unused. Examples of this are holidays, weekends and vacation periods at schools, weekdays at churches, and non-business hours including evenings and weekends at most places of business. Although the use of valuable land for such parking is needed, particularly in metropolitan areas, it presents a situation of considerable waste. Conservation and environmental problems have led to increasing consciousness of the need for responsibility in land use. Utilization of unused vehicle parking areas for alternate sports use demonstrates efficient land conservation and the social responsibility of the sponsoring organization or community.

The sport of tennis has become very popular and during the last 20 years the number of people playing this sport has increased greatly. This great increase of interest in the sport of tennis has led to a shortage of tennis court space and increasing court rental charges, particularly during vacation periods, weekends and other such times when more people are available for playing. The construction of tennis courts is a costly and at times limited activity due to the need for a large clear area on which some type of flat pavement is normally constructed in order to provide an appropriate playing surface for the tennis court.

Thus, faced with a shortage of tennis court space and with the knowledge that a great deal of suitable playing court space is available and at times largely unused, I have invented a tennis court construction and a method of installation which easily and quickly converts unused parking lot space area into useable tennis court space.

SUMMARY OF THE INVENTION

Briefly, one embodiment of the present invention provides for converting a parking lot area into useable tennis court space. In addition to the normal parking bay markings, typically white in color, there are provided one or more tennis court outlines on the pavement in a contrasting color, typically yellow. A permanent fence surrounds at least part of the parking lot area and the tennis courts are typically situated in the lot corner bounded by two lengths of this permanent fence. Removable netting fence sides provide additional fencing for substantially or completely enclosing the tennis court area.

The tennis court net posts and support poles for the removable fence netting are secured in the pavement surface by anchor assemblies. The holes needed for the anchor assemblies may be plugged with a cap when the tennis courts are not in use. U.S. Pats. Nos. 3,076,532; 1,459,723; 1,000,682 and 337,591 show examples of previous anchor systems used in supporting tennis net posts.

Thus a graded paved area is provided with two types of markings and two sets of anchor holes which receive complementary nets and fencing, when the selected paved area is to be enclosed for tennis court use. When not converted for sports use, all removable posts, nets and fencing are preferably stowed in a movable cart for convenient storage until needed.

Accordingly, a principal object of this invention is to provide apparatus and methods of installation for converting existing parking lot areas into temporary sports areas, such as tennis courts. Another object is to provide such methods and apparatus useful in constructing new parking areas providing this sports area conversion capability.

Further features and other objects and advantages of this invention will become more apparent from a study of the following more detailed description with reference to the drawings.

THE DRAWINGS

FIG. 1 is a top perspective view illustrating a layout of removable temporary tennis courts constructed on a parking lot area in accordance with the present invention, utilizing apparatus removed from a storage cart for erection;

FIG. 2 is an exploded perspective view showing the anchor construction used for supporting the tennis net posts and the associated cap for plugging the open hole;

FIG. 3 is a cross-sectional side elevation view showing the anchor construction used for supporting the temporary tennis court boundary fence netting poles and the associated cap for plugging the open hole;

Figure 5:
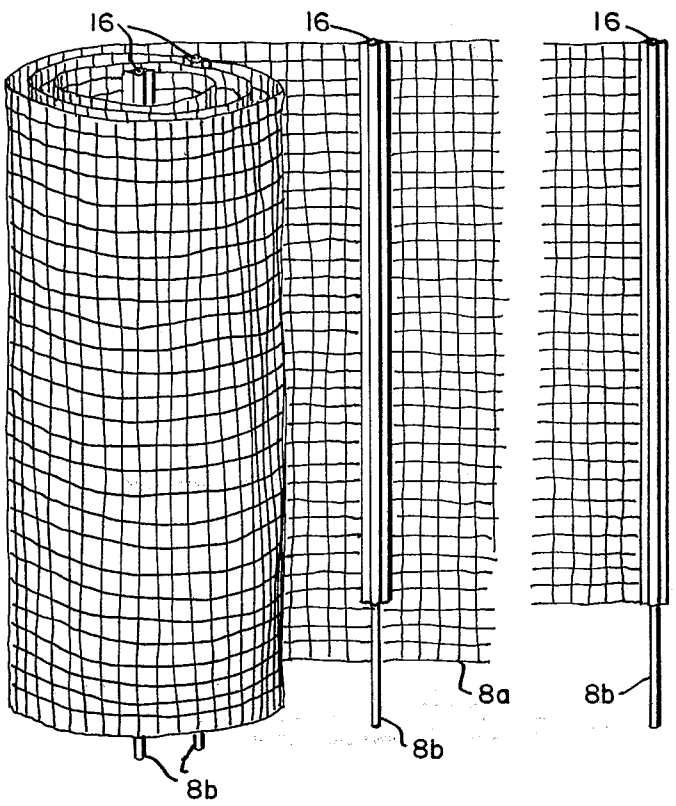
FIG. 5 is a fragmentary perspective view of an alternative netting-pole assembly.

In particular, and with reference to the foregoing drawings, a typical paved car parking lot is shown in FIG. 1 with parking bays marked off by lines 2, normally white in color. Further, a standard tennis court 4 has been laid out on the paved parking lot surface with narrower lines different in color from the parking bays, typically yellow or orange in color for high visibility. The parking lot is bordered by a standard permanent chain link fence 6 which also serves as the boundary for two sides of the tennis court area. An optional feature which may be incorporated in this chain link fence is one or more gates **6*a*** which allow easy access to the parking lot and tennis court areas.

The balance of the tennis court enclosure is provided by a set of temporary removable fences 8 which are erected when the parking lot area is to be used for tennis playing purposes.

The temporary fencing 8 may be left open in one or more spaces 7 to allow for easy entry and exit of players; as shown at the bottom portion of the temporary fencing in FIG. 1, fencing 8 comprises netting **8*a* arrayed between poles 8*b***.

Both the tennis court net and the temporary fencing netting have support posts and poles respectively which are secured in steel or plastic sleeves embedded in the paving surface. The tennis court net posts 9 are located in the cement anchor blocks 10, comprising a large concrete mass 10*a* cast around a plastic or steel sleeve 10*b*, as shown in FIG. 2, which receives the tennis net posts 9.

FIG. 3 illustrates the anchor 12 for the temporary fencing poles. This anchor construction consists of a hole bored in the pavement surface and the underlying earth and filled with a concrete sleeve 12*a* enclosing a plastic or steel sleeve 12*b* which receives the temporary fence poles 8*b*. Caps or stoppers 14 are provided for plugging the holes in both the tennis net posts sleeves and temporary fence post anchor sleeves when the court area is used for vehicle parking.

Figure 4:
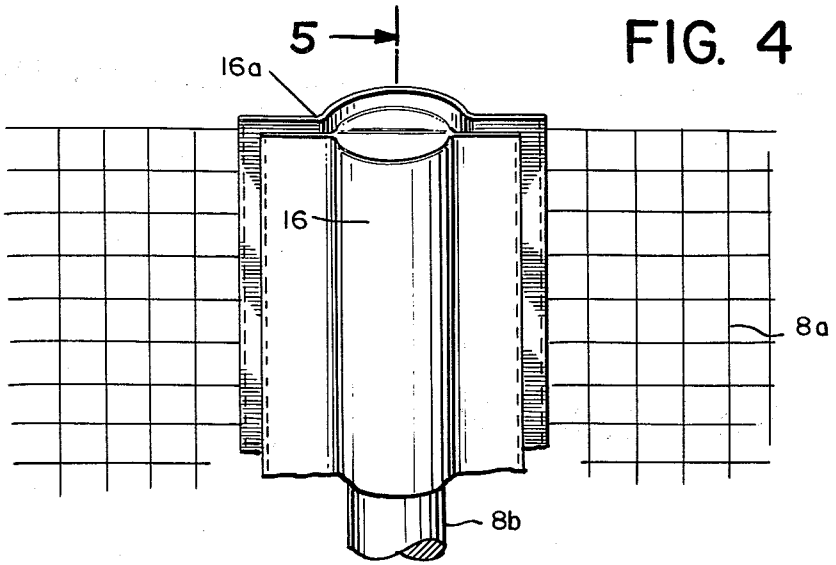
FIG. 4 is a greatly-enlarged fragmentary exploded perspective view showing the pole-sleeve employed with the temporary boundary netting of this invention.
Figure 6:
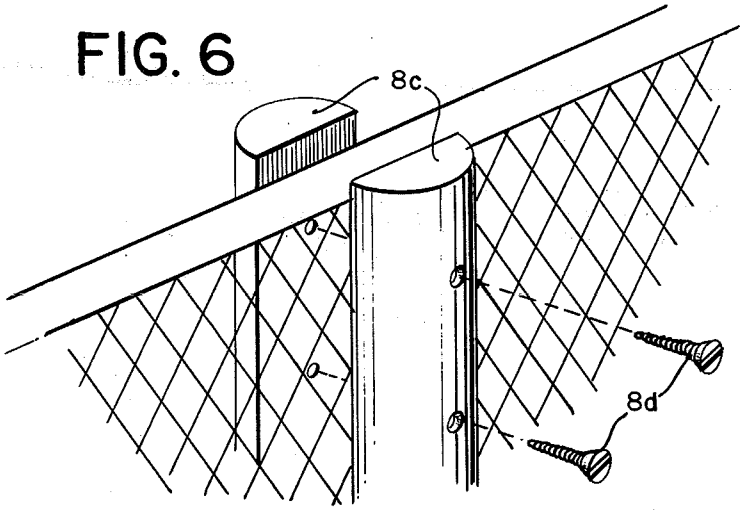
FIG. 6 is a front perspective view showing a length of temporary netting with poles in place, partially unrolled.

The temporary fencing 8, shown in FIGS. 4, 5 and 6, comprises nylon netting 8*a* and a series of support poles 8*b*. The nylon netting is attached to the support poles by means of two-part assemblies, vinyl sleeves 16 and parallel backing strips 16*a*. Sleeves 16 are sewn closed on the top and sides, thus encompassing the support pole. The vinyl sleeve 16 may be attached to the nylon netting 8*a* by several means including sewing, adhesive binding, riveting or lacing. The sleeve may be attached to two abutting sections of netting as shown in FIG. 4, or alternately the vinyl sleeves may be sewn or otherwise secured to a continuous length of netting. FIG. 6 further depicts the manner in which the temporary fence netting 8*a* may be rolled for storage in the cart 18.

DETAILED DESCRIPTION AND PREFERRED EMBODIMENT

The invention will now be described by the following detailed example, in which the details are given by way of illustration and not by way of limitation.

A typical parking lot of which a corner portion is shown in FIG. 1 might measure 135 by 225 feet, for example, and would accommodate approximately 60 cars in 10 by 20 foot bays, marked out with 4-inch wide white lines 2, with provisions for 25 foot-wide access driving lanes. Two standard tennis courts, marked out with 2-inch wide yellow lines 4, are located on one corner of the parking lot surface, using an area of approximately 105 feet by 120 feet, or about 40 car spaces. This leaves approximately 20 spaces for vehicle parking while courts are in use, for the convenience of tennis court users.

The parking bay white stripes 2 can easily be ignored by the tennis players in preference to the yellow tennis court markings 4. The tennis courts are located on the parking lot so that a permanent standard steel chain link fence 6 surrounding at least this corner of the parking lot forms the backstop fence for one side and one end of the tennis courts. The backstop screen for the other side and end of the courts are provided by a temporary nylon netting fence 8.

Poles 8*b* used for supporting the temporary nylon netting 8, and the tennis court net posts 9, are all secured to the court surface by means of an anchoring system. This anchoring system provides for a 4 by 30 inch steel or plastic sleeve 10*b* set in a concrete slab 10*a*, which may be a substantial concrete block measuring 36 by 18 by 32 inches deep, for example. Slabs 10*a* are located at appropriate spots centrally flanking the tennis court stripes 4, and are embedded beneath the parking lot surface, providing sturdy anchor sockets 10 well adapted to withstand high net tension loads imposed on the net posts 9. The longer horizontal dimension of these slabs 10*a* is aligned with the tennis net, to resist displacement of net posts 9 by this net tension.

A smaller 1¾ by 15 inch steel or plastic sleeve 12*b* is embedded in a concrete sleeve 12*a*, each positioned in a 3-inch diameter bored hole in the pavement surface and underlying earth, thus providing anchor sockets 12 for the removable fence netting poles 8*b*. Both types of sleeves 10*b* and 12*b* are provided with hard rubber caps or stoppers 14 which allow the holes to be plugged flush with the pavement when the space is to be used for parking. A small circular ring, attached to the top of the plug, which may lie flat, facilitates removal of the plug from the steel sleeve. Suitable drainage holes preferably extend downward from the bottom of sleeves 10*b* and 12*b* into underlying gravel drywells, as shown in FIG. 2.

The fence poles 8*b* may be tubular metal or wood approximately 15/8 inch in diameter and 11 feet 3 inches long, with 15 inches of the pole going into the sleeve in the pavement surface. The removable fence netting 8*a* extends 11 feet in total height and its uppermost 10 feet of height is secured to the fence poles 8*b* by a 10 foot long two-part vinyl sleeve 16, leaving the lowermost foot or so of netting height draped on the pavement to prevent the escape of low-flying or fast-rolling tennis balls.

The two-part sleeve 16 is sewn together on its top and sides, thus embracing the net pole 8*b*. The sleeve 16 is attached to the netting 8*a* at 15-foot intervals corresponding to the spacing between the netting pole anchors 12; sleeves 16 may be stitched or cemented at these intervals to a continuous length of netting, or to separate lengths which are thereafter joined together with each sleeve 16 acting as a "bridge." As shown in FIG. 4, sleeve 16 and a backing strip 16*a* may sandwich netting 8*a* between themselves for secure attachment thereto. Alternatively, as shown in FIG. 5, poles 8*b* may be formed of mating half-round portions 8*c* sandwiching netting 8*a* between themselves, and secured together by screws 8*d* or other suitable fastenings.

The temporary fence poles 8*b* are located such that the end poles 8*c* are situated very close, approximately 2 inches, from the permanent chain link fence 6. This construction, at the junctions of the permanent and temporary fencing, leaves only a small gap through which tennis balls cannot escape from the tennis court area.

If desired, asphalt coloring coatings such as Chevron "Colorcoat" No. 100 in either red or green may be applied to the graded paved surface. For example, the area inside the outer court boundary lines 4 may be colored green; the area outside that boundary and within the line of poles 8*b* may be colored red; the court boundary indicia 4 may be highly contrasting yellow or orange; and the parking bay markings 2*a* superimposed on the playing courts may be any pale color such as light green for visibility to drivers parking their cars without distracting players when they are using the playing courts.

One, two, three, four or any greater number of playing courts may be enclosed within the fencing. Removable temporary fence netting may be used without permanent fence if desired to enclose all or the major part of the playing court area boundary. A rolling towable or pushable trailer-type storage cart 18 (FIG. 1) provides the most convenient form of storage for the nets, netting, net posts, and poles when not installed. Removal of the towing tongue or towbar, and wheels 20 and their axles from cart 18, also permits this same storage cart 18 to be used for a shipping container and for permanent storage of all of the removable parts.

It should be noted that the disclosed articles and method of construction are easily adaptable to games other than tennis, such as badminton, volleyball, etc.

Convertible dual use of parking lot pavement for playing courts minimizes the owner's installation costs, and avoids permanent commitment of costly acreage for expensive playing court construction. It also eliminates responsibilities for maintenance and security against vandalism for detached or remote playing courts and parking areas constructed far from buildings, normal parking lots and and other facilities. In this manner, the use of petroleum-based or other paving materials is reduced, and destruction of green open space land is minimized, achieving land conservation in a highly desirable fashion and demonstrating the social responsibility of the owner.

While the present invention has been described with regard to certain embodiments and examples, it should be understood that it may be applied to other embodiments without departing from the spirit and scope of this invention.

It is also to be understood that the following claims are intended to cover all of the generic and specific features of the invention herein described, and all statements of the scope of the invention which, as a matter of language, might be said to fall therebetween.

Having thus described the invention in detail and with sufficient particularity as to enable those skilled in the art to practice it, what is described to have protected by Letters Patent is set forth in the following claims.

I claim:

1. A dual-purpose paved parking lot-playing court assembly convertible between primary use as a parking lot and alternative primary playing court use as tennis courts, badminton courts, volleyball courts or the like comprising:

a. means forming a substantially level pavement graded for drainage and marked in a first color with parking indicia designating a plurality of side-by-side vehicle parking locations;

b. playing court border indicia positioned on the pavement and applied in a second color contrasting with the parking indicia's first color and with the pavement surface color for high visibility;

c. temporary fencing removably mountable on the pavement in an extended configuration forming a border around at least a portion of the playing court border indicia;

d. at least two post anchoring sockets embedded in the substantially level pavement at points centrally located between opposed, facing end lines forming a portion of said border indicia; and e. net means incorporating 1. a net, and 2. a pair of net posts, the lower ends of which are securely mountable within the anchoring sockets, providing rigid, upstanding supports for maintaining the net extending therebetween taut and secure, whereby a paved parking lot is easily convertible to function alternatively as either a pre-marked vehicle parking area or a pre-marked playing area complete with peripheral fencing and rigid, tautly held netting in the playing court.

2. The convertible dual-purpose court assembly defined in claim 1, further including permanent fencing installed on the pavement around a portion of the playing court border indicia, with the removable temporary fencing having ends positionable closely adjacent to the permanent fencing, providing an enclosure around a major portion of the periphery of the playing court border indicia.

3. The convertible paved court assembly defined in claim 2, wherein the removable temporary fencing comprises an elongated panel of flexible netting retractable into closely packed storage configuration, and deployable into an extended configuration to form with the permanent fencing a fencing enclosure around the major proportion of the periphery of the playing courts defined by playing court border, indicia.

4. The paved court assembly defined in claim 3, wherein the flexible netting is supported by poles secured to the netting at spaced intervals therealong and having anchor ends extending downwardly from the lower edge of the netting, and further defined by means forming concave anchor sockets embedded in the pavement and having upward-facing pole-receiving open ends, arrayed at spaced intervals around the playing court border indicia and thereby defining the position of the flexible netting when its supporting poles are telescopingly inserted in the anchor sockets to extend the flexible netting into its temporary fencing configuration enclosing the playing courts.

5. The paved court assembly defined in claim 4, wherein said poles are formed with mating portions sandwichingly securing the flexible netting therebetween.

6. The paved court assembly defined in claim 1, wherein the net post anchor sockets comprise two rigid tubular post-receiving sleeves embedded in buried concrete blocks.

7. The paved court assembly defined in claim 6, wherein the concrete blocks are substantially elongated in the direction in which the net is supported between the net posts for maximum overturning resistance, to counteract net tension and form a stable net post anchor support.

8. The dual-purpose paved court assembly defined in claim 1, further including an associated storage container-cart dimensioned to receive the removable temporary fencing for storage when it is removed from the pavement.

9. The dual-purpose paved court assembly defined in claim 8, wherein the storage container-cart is provided with removable wheels and a removable towing tongue, whereby the container-cart is adapted for conversion to a non-rolling storage container.

10. The dual-purpose paved court assembly defined in claim 1, further including an associated storage container-cart dimensioned to receive the nets, net posts and removable temporary fencing and supporting poles for the temporary fencing for combined storage and transportation when they are removed from the pavement.

11. A dual-purpose paved parking lot-playing court assembly convertible to temporary sport use as tennis courts, badminton courts, volleyball courts or the like, comprising:

a. means forming a substantially level pavement grading for drainage and marked in a first color with parking indicia designating vehicle parking locations;

b. playing court border indicia positioned on the pavement and applied in a second color contrasting with the first color and with the pavement surface color for high visibility;

c. temporary fencing removably mountable on the pavement in an extended configuration forming a border around at least a portion of the playing court border indicia, and forming of an elongated panel of flexible netting retractable into closely packed storage configuration and deployable into an extended configuration, having secured thereto at spaced intervals a plurality of sleeves having upper blind ends and lower open ends;

d. a corresponding plurality of supporting poles telescopingly engaged in the sleeves and having anchor ends extending downwardly beyond the lower edge of the flexible netting; and e. means forming concave anchor sockets embedded in the pavement and having upward-facing pole-receiving open ends, arrayed at correspondingly spaced intervals around the playing court border indicia and thereby defining the position of the flexible netting when its supporting poles are telescopingly inserted in the anchor sockets to extend the flexible netting into its temporary fencing configuration.

* * * * *

UNITED STATES PATENT OFFICE
CERTIFICATE OF CORRECTION

Patent No. 3,982,758 Dated September 28, 1976

Inventor(s) Charles L. Howes, Jr.

It is certified that error appears in the above-identified patent and that said Letters Patent are hereby corrected as shown below:

Column 4, line 18 - "15/8" should be -- 1-5/8 --;

Column 5, line 32 - "described" should be -- desired --;

Column 6, line 16 - delete the comma between "border" and "indicia";

Column 6, line 66 - "grading" should be -- graded --;

Column 7, line 9 - "forming" should be -- formed --;

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*